US006698956B1

(12) United States Patent
Terao et al.

(10) Patent No.: US 6,698,956 B1
(45) Date of Patent: Mar. 2, 2004

(54) WIRE DOT PRINTER HEAD

(75) Inventors: Yasunobu Terao, Tagata-gun (JP); Takahiro Kawaguchi, Mishima (JP); Tetsuro Ichitani, Mishima (JP); Keishi Tsuchiya, Tagata-gun (JP); Takeshi Okui, Mishima (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/228,940

(22) Filed: Aug. 28, 2002

(51) Int. Cl.[7] ..... B41J 2/275

(52) U.S. Cl. ..... 400/124.23; 400/124.11

(58) Field of Search ..... 400/124.11, 124.12, 400/124.13, 124.14, 124.15, 124.16, 124.17, 124.2, 124.21, 124.8, 124.23, 124.24, 124.31

(56) References Cited

U.S. PATENT DOCUMENTS 4,167,343 A * 9/1979 Golobay ..... 400/124.2
4,976,554 A * 12/1990 Shimosato et al. .... 400/124.21

FOREIGN PATENT DOCUMENTS

JP 03007351 A * 1/1991 ..... B41J/2/275
JP 04065253 A * 3/1992 ..... B41J/2/275
JP 04105945 A * 4/1992 ..... B41J/2/275
JP 2001-219586 8/2001

* cited by examiner

*Primary Examiner*—Daniel J. Colilla
(74) *Attorney, Agent, or Firm*—Oblon, Spivak, McClelland, Maier & Neustadt, P.C.

(57) ABSTRACT

In the wire dot printer head of the present invention, an armature adapted to move pivotally between a printing position and a stand-by position is provided with a pivot shaft serving as a fulcrum, and the pivot shaft is pinched and supported by a pair of support members from both sides in the pivoting direction of the pivot shaft. In at least one support member is formed a concave support groove into which an outer periphery surface of the pivot shaft is inserted in a state of surface contact with the groove. When the armature moves pivotally in a printing operation, the surface of contact increases because the pivot shaft and the pivot groove are in surface contact with each other, thus preventing the occurrence of a local concentration of a strong force on the contact portion between the pivot shaft and the support groove. Besides, such a motion of the pivot shaft as being rubbed against the other support member is restricted by the aforesaid surface contact, whereby the wear between the pivot shaft and the other support member is also diminished. Consequently, wobbling of the pivot shaft during printing is prevented and variations in a wire tip position are also prevented, thus ensuring a high print quality.

9 Claims, 6 Drawing Sheets

WIRE DOT PRINTER HEAD

BACKGROUND OF THE INVENTION

1. Field of the Invention

The present invention relates to a wire dot printer head provided in a wire dot printer and more particularly to a wire dot printer head having armatures with printing wires connected to the armatures respectively, the armatures being each adapted to pivot about a pivot shaft and between a printing position and a stand-by position.

2. Description of the Background Art

Heretofore there has been known a wire dot printer head wherein an armature with printing wire connected thereto is moved pivotally between a printing position and a stand-by position and a tip of the wire is caused to strike against printing paper when the armature is pivoted to the printing position, to effect printing.

In such a wire dot printer head it is necessary that the tip position of the wire be kept constant when the armature pivots to the printing position, thereby maintaining the printing pressure constant. To meet this requirement it has been proposed to provide a pivot shaft in the armature, allowing the armature to pivot stably about the pivot shaft.

In this case it is necessary that the pivot shaft be supported in a positionally fixed state by some suitable means. An example of a method for supporting the pivot shaft is pinching the pivot shaft between two opposed support members from both sides in the pivoting direction of the armature. In case of thus pinching the pivot shaft between two opposed support members, the pivot shaft comes into linear contact with the two support members.

Once the pivot shaft is pinched in linear contact with the two support members, a strong force is concentrated on the linear contact portions between the support members and the pivot shaft as the armature moves pivotally in printing, so that wear is apt to occur in the linear contact portions of the pivot shaft or the support members and the wear causes wobbling of the support shaft.

Once there occurs wobbling of the pivot shaft in printing due to such wear of the pivot shaft or the support members, there occur variations in the wire tip position during printing and there also occur variations in printing pressure, with consequent deterioration of the print quality.

Moreover, if wear dust resulting from the wear adheres to the armature, the pivotal motion of the armature may be obstructed.

Further, upon wobbling of the pivot shaft, the opposition area between members which constitute magnetic circuits for pivoting the armature varies, and when the opposition area becomes small, there increases a magnetic resistance, causing deterioration of the armature pivoting performance.

SUMMARY OF THE INVENTION

Accordingly, it is an object of the present invention to prevent the occurrence of wear of a pivot shaft serving as a fulcrum of an armature or wear of support members which pinch and support the pivot shaft and further prevent the occurrence of various inconveniences caused by wear of the pivot shaft or support members such as variations in printing pressure and consequent deterioration of the print quality, obstruction of a pivotal motion of the armature caused by the adhesion of resulting wear dust to the armature, and an increase of a magnetic resistance between members which constitute magnetic circuits and consequent obstruction of a pivotal motion of the armature.

The above object of the present invention is achieved by a novel wire dot printer head of the present invention.

According to the novel wire dot printer head of the present invention, a support groove having a concave shape is formed in at least one of support members which pinch and support a pivot shaft of an armature, and an outer periphery surface of the armature pivot shaft is allowed to get into the support groove in a state of surface contact with the groove, to increase the area of contact between the pivot shaft and the support members and prevent a local concentration of a strong force on the contact portions of the pivot shaft or the support members, thereby diminishing wear of the contact portions of the pivot shaft or the support members.

BRIEF DESCRIPTION OF THE DRAWINGS

A more complete understanding of the present invention and many associated advantages will be obtained from a reading and better understanding of the following detailed description when the same is read in connection with the accompanying drawings.

DETAILED DESCRIPTION OF THE PREFERRED EMBODIMENTS

An embodiment of the present invention will be described hereinunder with reference to FIGS. 1 to 4.

Figure 1:
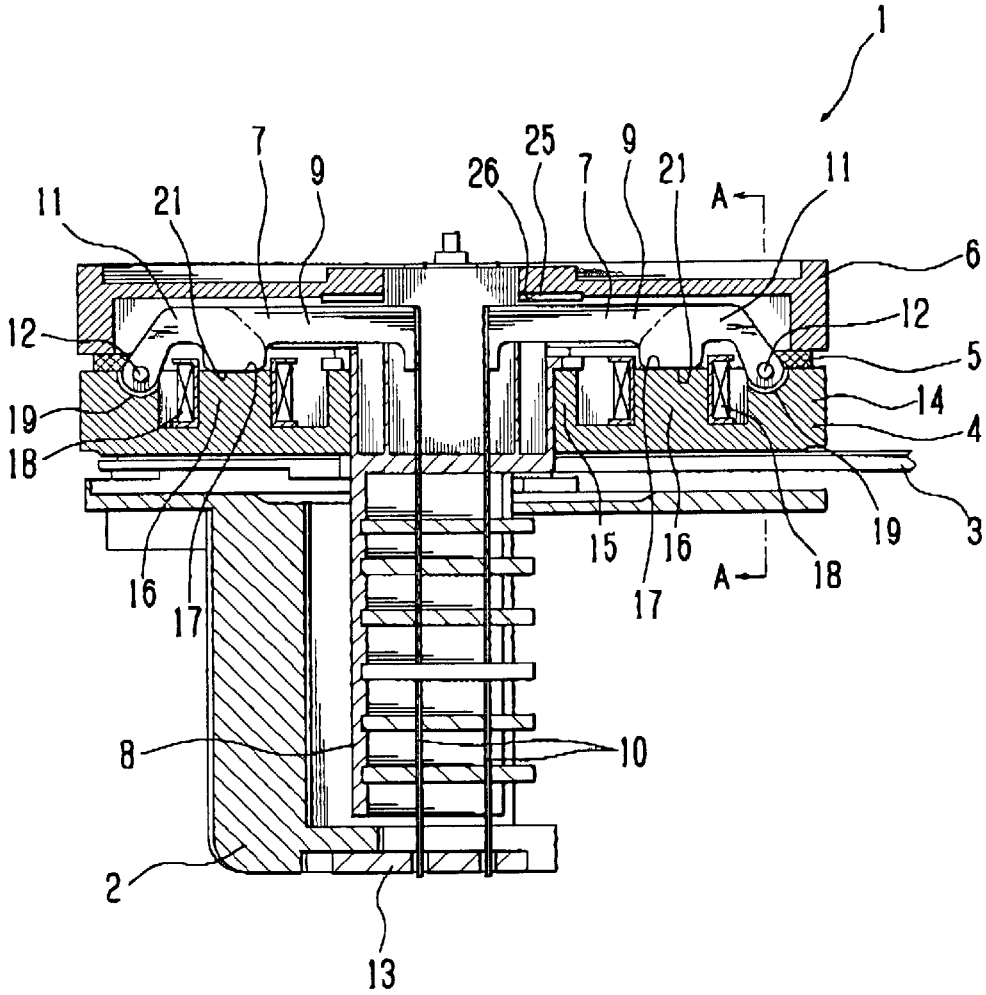
FIG. 1 is a front view in central vertical section of a wire dot printer head according to the present invention.
Figure 2:
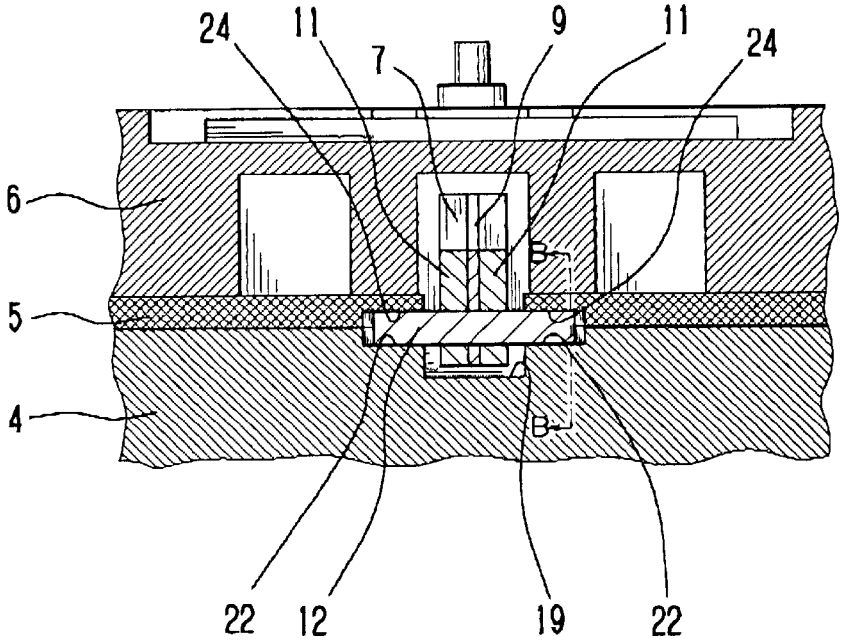
FIG. 2 is a sectional view taken on line A—A in FIG. 1 for explaining an armature support structure.
Figure 3:
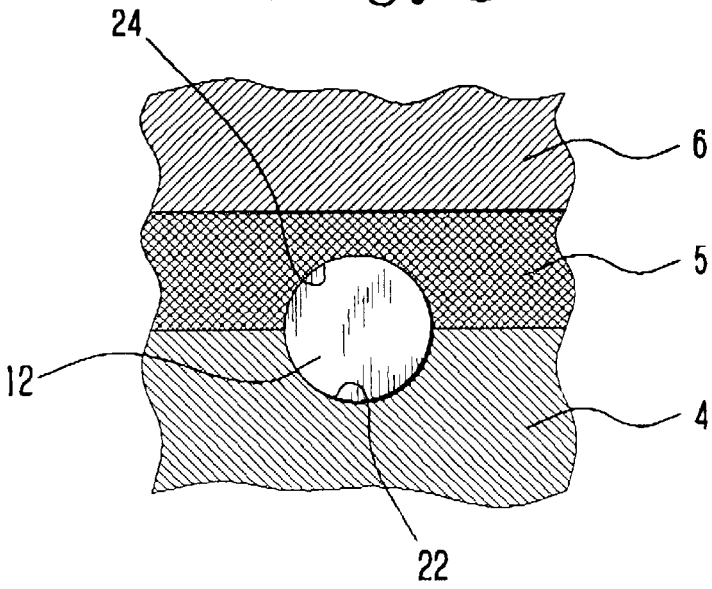
FIG. 3 is a sectional view taken on line B—B in FIG. 2 for explaining a pivot shaft support structure.
Figure 4:
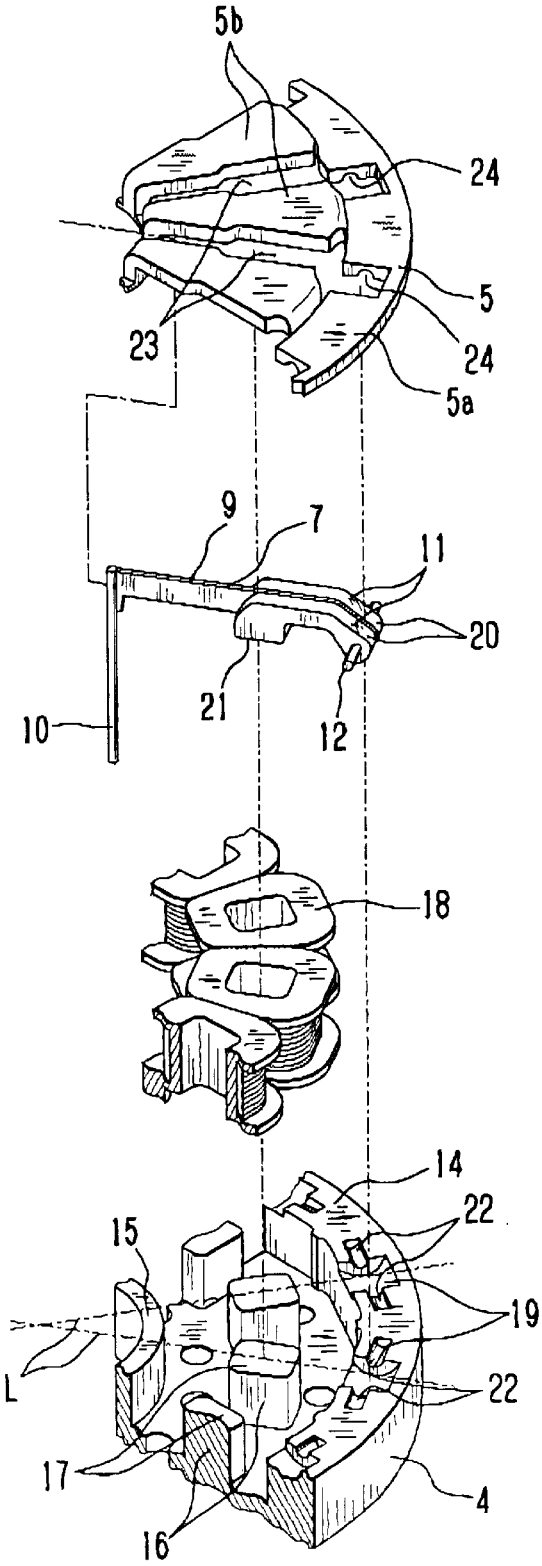
FIG. 4 is a partially cut-away exploded perspective view of a yoke and an armature spacer for explaining the armature support structure.

First, with reference to FIG. 1, a description will be given about the entire construction of a wire dot printer head 1 embodying the invention. The wire dot printer head 1 comprises a front case 2, a circuit board 3, a yoke 4 as a support member, an armature spacer 5 as a support member, a rear case 6, plural armatures 7, and a wire guide 8. The front case 2 and the rear case 6 are coupled together with use of mounting screws (not shown), and the circuit board 3, yoke 4, armature spacer 5, armatures 7, and wire guide are held grippingly between the front case 2 and the rear case 6. The plural armatures 7 are arranged radially.

The armatures 7 are each made up of an arm 9, a wire 10 soldered to one end side of the arm 9, magnetic circuit forming members 11 welded to both side faces of the arm 9, and a cylindrical pivot shaft 12 provided on an opposite end side of the arm 9. Each armature 7 is supported pivotably between a printing position and a stand-by position with the pivot 12 being as a center. With this pivotal motion of the armature, the wire 10, which is guided by the wire guide 8, performs a sliding motion. When the armature 7 pivotally reaches the printing position, a tip of the wire 10 strikes against printing paper to effect printing. At a front end portion of the front case 2 there is provided a tip guide 13 for holding the tip of each slidable wire 10 in a line in accordance with a predetermined pattern.

The yoke 4, which is formed of a magnetic material, has a cylindrical portion 14 on an outer periphery side and a cylindrical portion 15 on an inner periphery side, with plural cores 16 being formed between the cylindrical portions 14 and 15. Coils 18 are mounted on outer peripheries of the cores 16. Plural recesses 19 are formed in an upper surface of the cylindrical portion 14. The number of the cores 16, that of the recesses 19, and that of the armatures 7 are the same. The recesses 19 are formed on virtual straight lines L joining the center of the yoke 4 and the centers of pole faces 17 of the cores 16, and the armatures 7 are arranged on the virtual straight lines L.

On one end side of each magnetic circuit forming member 11 is formed a supported member 20, while on an opposite end side thereof is formed a attracted face 21. When the armatures 7 are arranged on the virtual straight lines L, the supported portions 20 of the magnetic circuit forming members 12 get into the recesses 19 formed in the cylindrical portion 14 and the attracted faces 21 become opposed to the pole faces 17 of the cores 16.

On both sides of each recess 19 and at positions orthogonal to the associated virtual straight line L there are formed support grooves for insertion therein of the pivot shaft 12. An inner periphery surface of each support groove 22 is formed in a concave shape with a radius of curvature equal to that of an outer periphery surface of the pivot shaft 12. The depth of each support groove 22 is set approximately equal to the radius of the pivot shaft 12. As a result, when the armatures 7 are arranged on the virtual straight lines L, an approximately half in sectional area of each pivot shaft 12 gets into the associated support grooves 22 and the outer periphery surface of the pivot shaft 12 and the inner periphery surface of the support grooves 22 come into surface contact with each other.

The armature spacer 5 is made up of a ring-shaped portion 5*a* opposed to the cylindrical portion 14 of the yoke 4 and plural guide portions 5*b* which are radially arranged inside the ring-shaped portion 5*a*. Guide grooves 23, in which the armatures 7 are arranged respectively, are formed in such a manner that each guide groove 23 is positioned between adjacent guide portions 5*b*. Support grooves 24 for insertion therein of the pivot shafts 12 of the armatures 7 are formed in a surface of the ring-shaped portion 5*a* which surface is opposed to the cylindrical portion 14. The support grooves 24 are each formed in a concave shape with a radius of curvature equal to or a little larger than that of the outer periphery surface of each pivot shaft 12. The depth of each of the support grooves 24 is set to be approximately equal to the radius of the pivot shaft 12.

The armatures 7 are arranged on the virtual straight lines L and the armature spacer 5 is disposed at a predetermined position so that its ring-shaped portion 5*a* is opposed to the cylindrical portion 14, further, the circuit board 3 and the wire guide 8 are disposed at predetermined positions and the front and rear cases 2, 6 are coupled together with use of mounting screws, whereby the pivot shafts 12 are sandwiched in between the support grooves 22 and 24 and the outer periphery surfaces thereof come into surface contact with the inner periphery surfaces of the support grooves 22, 24.

A metallic annular armature stopper 25 is mounted at a center of the rear case 6. The mounting of the armature stopper 25 to the rear case 6 is performed by fitting the armature stopper 25 into a mounting recess 26 formed in the rear case 6. When an armature 7 pivots from the printing position to the stand-by position, the arm 9 as part of the armature 7 comes into abutment against the armature stopper 25 and thus the armature stopper defines the stand-by position of the armature 7.

As to the construction of the wire dot printer using the wire dot printer head 1, it is already known, so only the principle thereof will here be described briefly. As to the other components that the wire dot printer head 1 which constitute the wire dot printer, explanations will be given with drawings thereof omitted. The wire dot printer head 1 is mounted on a carriage which is reciprocated along a platen. Printing paper is fed between the platen and the wire dot printer head 1 by conveying rollers. In case of using a pressure-sensitive color-developing paper as the printing paper, the paper develops color under the pressure of wire 10 which is driven, to effect printing. In case of using plain paper as the printing paper, the plain paper undergoes the pressure of wire 16 through an ink ribbon, whereby the ink of the ink ribbon is transferred onto the plain paper to effect printing.

When a certain coil 18 is energized during a printing operation by the wire dot printer, a magnetic circuit is formed among the core 16 on which the coil 18 is mounted, the magnetic circuit forming members 11 of the armature 7 opposed to the core 16, and the outer- and inner-periphery side cylindrical portions 14, 15 of the yoke 4. As a result, the armature 7 moves pivotally about the pivot shaft 12 in a direction in which the attracted faces 21 of the magnetic circuit forming members 11 are attracted to the pole face of the core 16. The pivoted position of the armature 7 at this time is the printing position shown in FIG. 1, and as a result of a pivotal movement of the armature to the printing position the tip of wire 10 projects to the printing paper side to effect printing.

When the coil 18 is de-energized, the magnetism so far developed becomes extinct and the armature 7 moves pivotally about the pivot shaft 12 toward the stand-by position with an urging force of an urging member (not shown). When the armature 7 pivotally reaches the stand-by position, its arm 9 is put in abutment against the armature stopper 25, whereby the armature 7 is stopped at the stand-by position.

When the armature 7 pivots between the printing position and the stand-by position, the pivot shaft 12 is supported while being sandwiched between the associated support grooves 22 formed in the yoke 4 and the associated support grooves 24 formed in the armature spacer 5, and the outer periphery surface of the pivot shaft 12 is put in surface contact with the inner periphery surfaces of the support grooves 22 and 24. As a result, the area of contact between the pivot shaft 12 and the support grooves 22, 24 formed in the yoke 4 and the armature spacer 5 as support members for pinching and supporting the pivot shaft becomes larger. For this reason, when the armature 7 pivots between the printing position and the stand-by position, centered on the pivot shaft 12, a locally strong force is not concentrated on the contact portions of the pivot shaft 12 or the support grooves 22, 24, whereby the wear of the pivot shaft and the support grooves is diminished and wobbling of the support shaft does not occur.

Consequently, the wires 10 do not undergo variations in their tip positions during printing and the printing pressure can be kept constant over a long period, whereby a high printing quality can be ensured over a long period.

Besides, since the wear of the pivot shafts 12 and support grooves 22, 24 is diminished, the formation of wear dust is suppressed and the obstruction of the armature pivoting motion caused by the adhesion of wear dust to the armature 7 is prevented.

Moreover, since wobbling of the support shafts 12 does not occur, it is possible to keep maximum the area of the opposed portions between the supported portions 20 of the magnetic circuit forming members 11 and side faces of the recesses 19. As a result, the magnetic resistance of the magnetic circuits can be kept low and the attractive force acting on each armature 7 can be kept high, whereby a satisfactory performance can be ensured for moving the armature 7 to the printing position.

Another embodiment of the present invention will now be described with reference to FIGS. 5 to 8. The same portions as in FIGS. 1 to 4 will be identified by like reference numerals and explanations thereof will be omitted.

Figure 5:
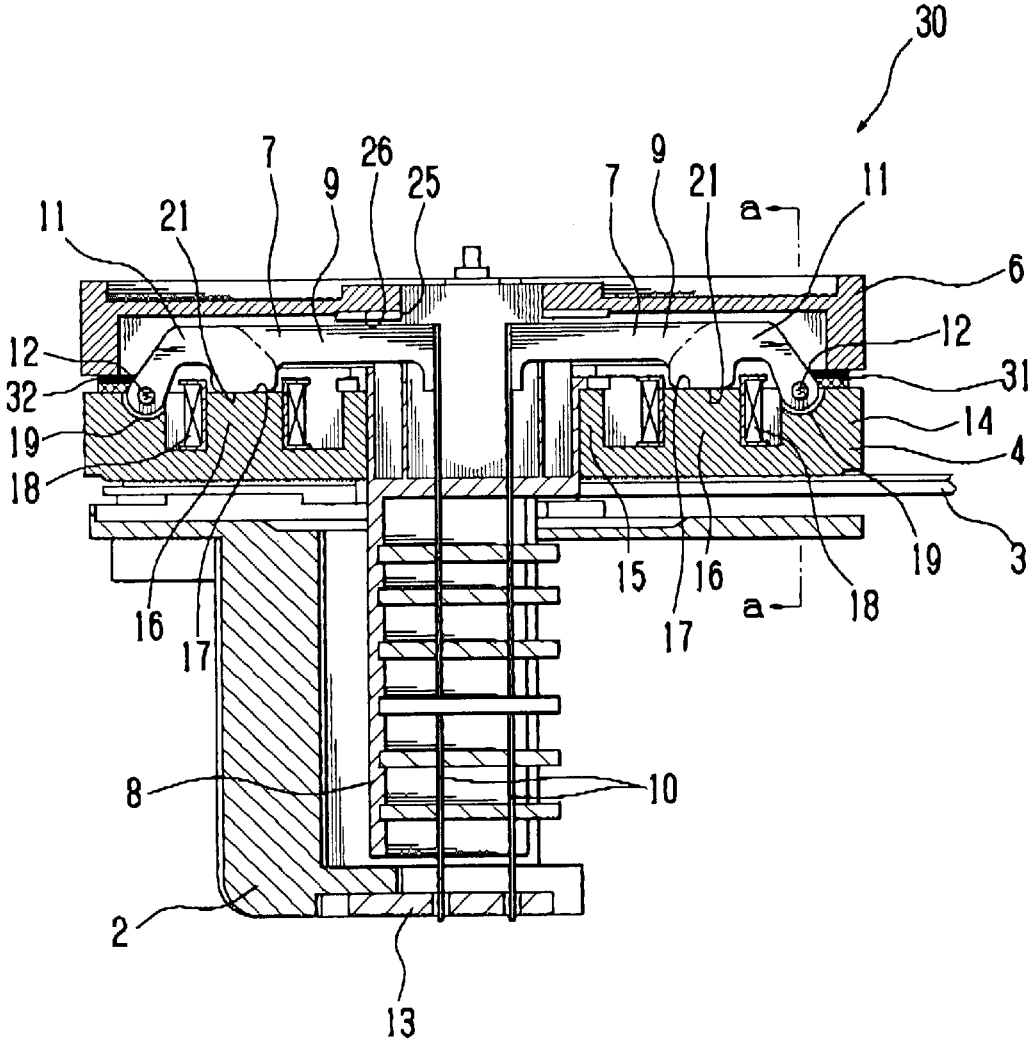
FIG. 5 is a front view in central vertical section of another wire dot printer head.
Figure 6:
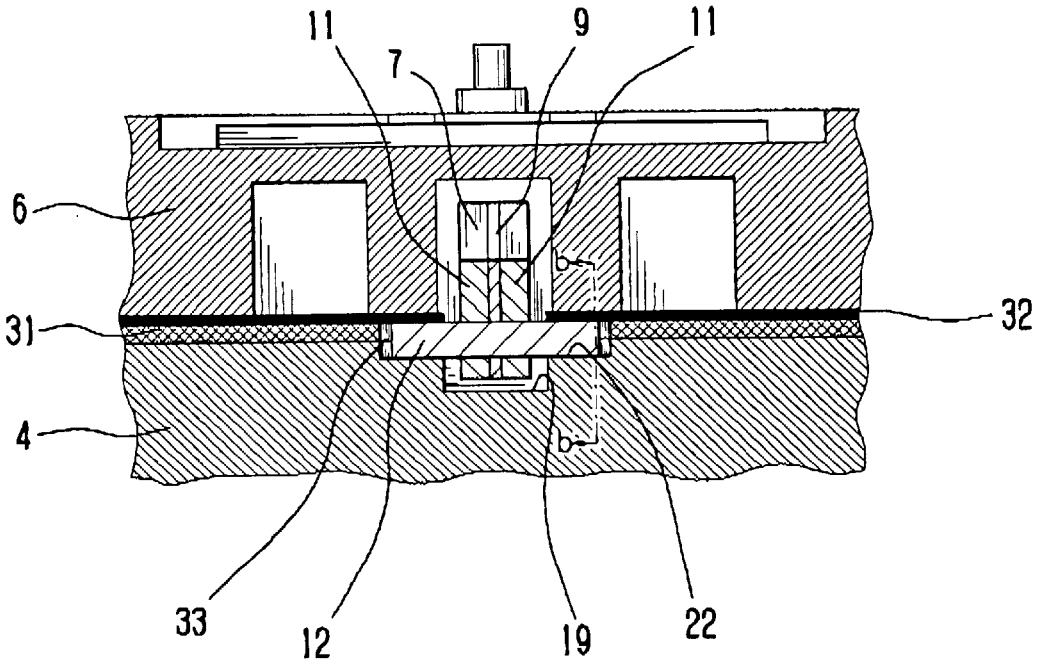
FIG. 6 is a sectional view taken on line a—a in FIG. 5 for explaining an armature support structure.
Figure 7:
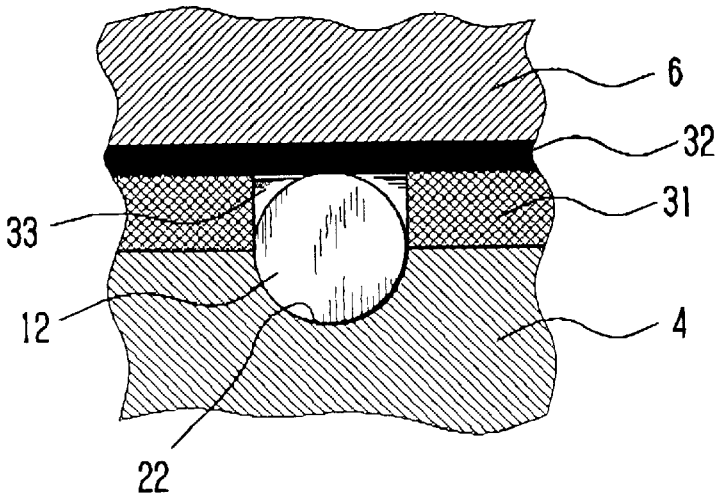
FIG. 7 is a sectional view taken on line b—b in FIG. 6 for explaining a pivot shaft support structure.
Figure 8:
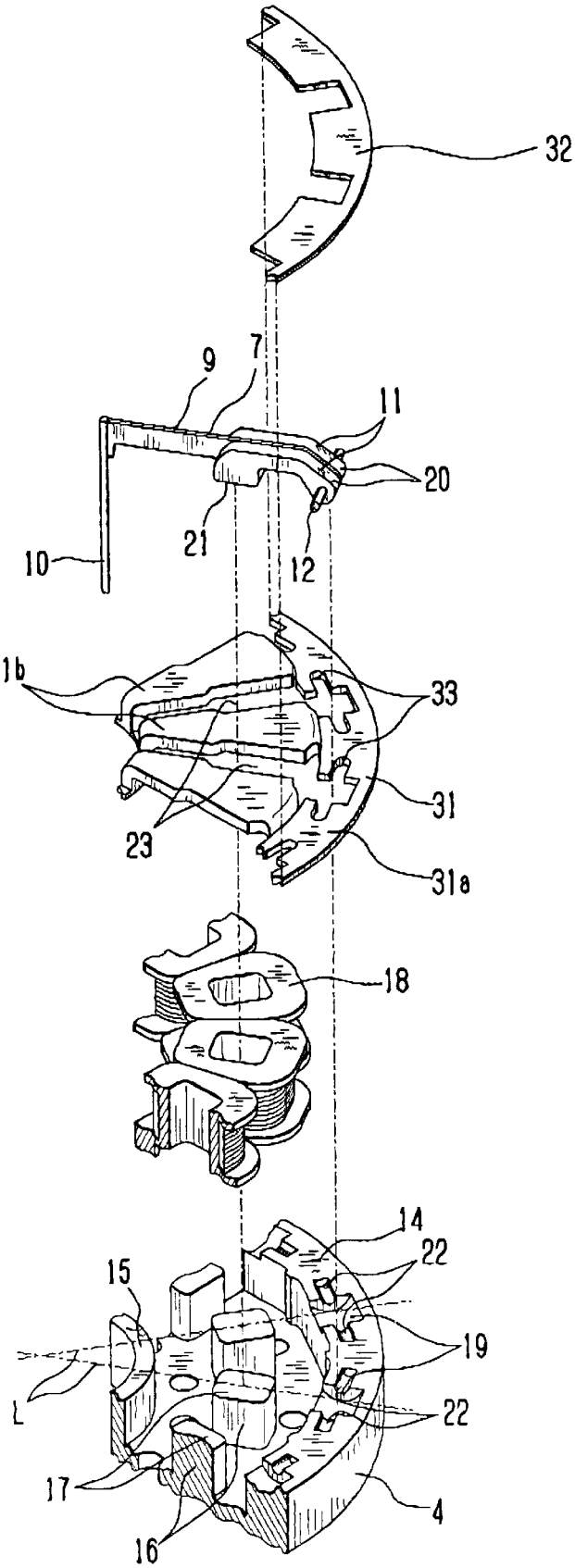
FIG. 8 is a partially cut-away exploded perspective view of a yoke, an armature spacer, and a resin film for explaining the armature support structure.

First, with reference to FIG. 5, a description will be given about the entire construction of a wire dot printer head 30. A basic structure of the wire dot printer head 30 is the same as that of the wire dot printer head 1 shown in FIG. 1. The wire dot printer head 30 comprises a front case 2, a circuit board 3, a yoke 4 as a support member, an armature spacer 31, a resin film 32, a rear case 6 as a support member, plural armatures 7, and a wire guide 8. The front case 2 and the rear case 6 are coupled together with use of mounting screws (not shown), and the circuit board 3, yoke 4, armature spacer 31, resin film 32, armatures 7, and wire guide 8 are held grippingly between the front case 2 and the rear case 6. The plural armatures 7 are arranged radially.

The armature spacer 31 is made up of a ring-shaped portion 31*a* opposed to a cylindrical portion 14 of the yoke 4 and plural guide portions 31*b* which are radially arranged inside the ring-shaped portion 31*a*. Guide grooves 23 for insertion therein of the armatures 7 are formed in such a manner that each guide groove 23 is positioned between adjacent guide portions 31*b*. Grooves 33 for insertion therein of the pivot shafts 12 are formed in the ring-shaped portion 31*a* at positions opposed to support grooves 15. The thickness of the ring-shaped portion 31*a*, i.e., the depth of each groove 33, is set approximately equal to the radius of each pivot shaft 12.

The resin film 32 is formed of a polyimide resin, possessing resistance to both wear and heat. The resin film 32 is formed in a ring shape to cover the ring-shaped portion 31*a* of the armature spacer 31 and is held in a sandwiched state between the ring-shaped portion 31*a* and the rear case 6. Instead of the resin film 32 there may be used a metal such as stainless steel having been subjected to a rust preventing treatment.

The armatures 7 are arranged on virtual straight lines L, the armature spacer 31 is disposed in a predetermined position in which the ring-shaped portion 31*a* is opposed to the cylindrical portion 14, the resin film 32 is disposed on the ring-shaped portion 31*a*, the circuit board 3 and the wire guide 8 are arranged at predetermined positions, and the front and rear cases 2, 6 are coupled together with use of mounting screws, whereby a semicircle portion of an outer periphery surface of each pivot shaft 12 comes into surface contact with inner periphery surfaces of the associated support grooves 22 and the outer periphery surface of the pivot shaft 12 comes into linear contact with the resin film 32.

At the time of printing operation by the wire dot printer using the wire dot printer head 30 described above, an armature 7 pivots to the printing position upon energization of the associated coil 18. When the coil 18 is de-energized, the armature pivots to the stand-by position and printing is performed with the pivotal motion.

When an armature 7 pivots between the printing position and the stand-by position, its pivot shaft 12 is pinched and supported between the associated support grooves 22 formed in the yoke 4 and the resin film 32, and the outer periphery surface of the pivot shaft 12 comes into surface contact with the inner periphery surfaces of the support grooves 22 and comes into linear contact with the resin film 32. Thus the pivot shaft 12 and the support grooves 22 are in surface contact with each other and the area of the contact is large, so when the armature 7 pivots between the printing position and the stand-by position, centered on the pivot shaft 12, there does not occurs a local concentration of a strong force on the contact portions of the pivot shaft 12 and the support grooves 22 and hence the wear of the pivot shaft 12 and that of the support grooves 22 are diminished. On the other hand, the pivot shaft 12 and the resin film 32 are in linear contact with each other, but approximately a semicircle portion of the outer peripheral surface of the pivot shaft 12 is in surface contact with the support grooves 22 and its movement is restricted thereby, so such a movement as being rubbed is restricted also in the contact portion of the pivot shaft 12 with the resin film 32 and the occurrence of wear is suppressed despite of the linear contact. Further, since the pivot shaft 12 is in linear contact with the resin film 32 which is difficult to undergo wear, the wear of the pivot shaft is diminished in comparison with the case where the pivot shaft is brought into linear contact with the metallic rear case 6 directly.

Therefore, even if the armature 7 repeats a pivotal movement between the printing position and the stand-by position, the wear of the pivot shaft 12, support grooves 22 and resin film 32 are diminished and wobbling of the pivot shaft 12 does not occur during printing. Consequently, variations in the tip positions of wires 10 do not occur during printing and hence the printing pressure can be kept constant and the print quality can be kept high both over a long period.

Moreover, since the wear of the pivot shafts 12, support grooves 22 and resin film 32 is diminished, the occurrence of wear dust is suppressed and the obstruction of the pivotal motion of each armature 7 caused by the adhesion of wear dust thereto is prevented.

Further, since wobbling of the pivot shafts 12 does not occur, it is possible to keep maximum the area of the opposed portions between the supported portions 20 of the magnetic circuit forming members 11 and side faces of the recesses 19. As a result, not only the magnetic circuits can be kept low in magnetic resistance, but also the attractive force acting on each armature 7 can be kept high and hence the performance of causing the armature 7 to move pivotally to the printing position can be maintained in a satisfactory condition.

In the light of the above description it is obvious that many modifications and changes of the present invention may be made. Accordingly, it is understood that within the scope of the appended claims the present invention can be practiced in other modes than those described above concretely.

What is claimed is:

1. A wire dot printer head comprising:

an armature capable of moving pivotally between a printing position and a stand-by position;

a printing wire fixed to one end side of the armature and adapted to slide with the pivotal movement of the armature;

a pivot shaft provided on an opposite end side of the armature and serving as a fulcrum of the armature;

a pair of support members for pinching and supporting the pivot shaft from two sides in a direction perpendicular to a rotational axis of the pivot shaft;

a support groove formed in at least one of the support members and having a concave shape into which an outer periphery surface of the pivot shaft is inserted in a state of surface contact with the groove; and a support groove formed in the other support member and having a concave shape into which the outer periphery surface of the pivot shaft is inserted in a state of surface contact with the groove.

2. A wire dot printer head according to claim 1, wherein a depth of the support groove is approximately equal to a radius of the pivot shaft.

3. A wire dot printer head according to claim 1, wherein a radius of curvature of an inner periphery surface of the support groove is approximately equal to a radius of curvature of the outer periphery surface of the pivot shaft.

4. A wire dot printer head according to claim 1, wherein a depth of the support groove formed in the one support member and a depth of the support groove formed in the other support member are each approximately equal to a radius of the pivot shaft.

5. A wire dot printer head according to claim 1, wherein a radius of curvature of an inner periphery surface of the support groove formed in the one support member and a radius of curvature of an inner periphery surface of the support groove formed in the other support member are each approximately equal to a radius of curvature of the outer periphery surface of the pivot shaft.

6. A wire dot printer head comprising:

an armature capable of moving pivotally between a printing position and a stand-by position;

a printing wire fixed to one end side of the armature and adapted to slide with the pivotal movement of the armature;

a pivot shaft provided on an opposite end side of the armature and serving as a fulcrum of the armature;

a pair of support members for pinching and supporting the pivot shaft from two sides in a direction perpendicular to a rotational axis of the pivot shaft; and a support groove formed in at least one of the support members and having a concave shape into which an outer periphery surface of the pivot shaft is inserted in a state of surface contact with the groove, wherein a spacer member is disposed between the one support member and the other support member, the spacer member having a groove for insertion therein of the pivot shaft, and a resin film having wear resistance is interposed between the spacer member and the other support member, the resin film being put in abutment against the outer periphery surface of the pivot shaft.

7. A wire dot printer head according to claim 6, wherein a depth of the support groove formed in the one support member is approximately equal to a radius of the pivot shaft, and a thickness of the spacer member is approximately equal to a radius of the pivot shaft.

8. A wire dot printer head according to claim 6, wherein the resin film is formed of a polyimide resin.

9. A wire dot printer head according to claim 7, wherein the resin film is formed of a polyimide resin.

* * * * *